US010285482B2

(12) United States Patent
Locatelli

(10) Patent No.: US 10,285,482 B2
(45) Date of Patent: May 14, 2019

(54) HAIR CLIP WITH FLEXIBLE JOINING MEMBER

(71) Applicant: Sarah Locatelli, Grass Valley, CA (US)

(72) Inventor: Sarah Locatelli, Grass Valley, CA (US)

( * ) Notice: Subject to any disclaimer, the term of this patent is extended or adjusted under 35 U.S.C. 154(b) by 162 days.

(21) Appl. No.: 15/062,508

(22) Filed: Mar. 7, 2016

(65) Prior Publication Data

US 2017/0251782 A1 Sep. 7, 2017

(51) Int. Cl.

| | |
|---|---|
| ***A45D 8/22*** | (2006.01) |
| ***A45D 8/26*** | (2006.01) |
| ***A45D 8/32*** | (2006.01) |
| *A45D 8/00* | (2006.01) |

(52) U.S. Cl.

CPC ..... *A45D 8/26* (2013.01); *A45D 8/32* (2013.01); *A45D 2008/004* (2013.01)

(58) Field of Classification Search

CPC ... A45D 8/14; A45D 8/20; A45D 8/22; A45D 8/26; A45D 8/24; A45D 8/00; A45D 8/32; A45D 2008/004

See application file for complete search history.

(56) References Cited

U.S. PATENT DOCUMENTS

| | | | | | |
|---|---|---|---|---|---|
| 5,445,170 | A * | 8/1995 | Yasuda | A45D 8/24 | 132/278 |
| 5,894,850 | A * | 4/1999 | Kimura | A45D 8/30 | 132/279 |
| 7,766,020 | B2 * | 8/2010 | Chininis | A45D 8/26 | 132/278 |
| 2004/0055617 | A1 * | 3/2004 | Brantley | A45D 8/24 | 132/278 |
| 2008/0156343 | A1 * | 7/2008 | Chininis | A45D 8/26 | 132/278 |
| 2010/0326460 | A1 * | 12/2010 | Hsu | A45D 8/14 | 132/277 |
| 2012/0012132 | A1 * | 1/2012 | Kowalski | A45D 8/26 | 132/279 |
| 2016/0331099 | A1 * | 11/2016 | Stanley | A45D 8/14 | |

* cited by examiner

*Primary Examiner* — Rachel R Steitz
(74) *Attorney, Agent, or Firm* — Michael A. Guth

(57) ABSTRACT

The present invention is directed towards a hair clip with a flexible arm. The hair clip is adapted to fasten around a portion of the user's hair. The flexible arm is adapted to bend around a section of the user's hair such that the effective length of the flexible arm changes, and then lines up with a clip on a mating portion of the clip. The clip with the flexible arm puts less pressure on the hair than a standard hair clip.

15 Claims, 10 Drawing Sheets

HAIR CLIP WITH FLEXIBLE JOINING MEMBER

BACKGROUND

Field of the Invention

The present invention relates to a hair clip adapted to minimize damage to hair.

Description of Related Art

In many circumstances women may prefer to fasten their hair with hair clips. A hair clip can hold all or part of a user's hair. The hair can be pulled back, up, aside, or away from a user's face. Hair clips may also have decorative attachments to add ornamentation to the functionality of the clip. Once the hair is styled and the clip is affixed, it may be desired to keep the clip in place for quite some time.

A disadvantage of hair clips is that the pressure placed upon the hair, in the region where the hair is clasped around by the clip, may be too high, and may result in damaged hair. Some of the clasped hair may break in the region where it passes through the clip. Previously, the goal of firmly grasping the hair with the hair clip has been at odds with the protection of the hair from damage.

What is called for is a hair clip which may effectively clasp around a portion of the user's hair without undue pressure on the clasped hair. What is also called for is a low force hair clip which nonetheless effectively does clasp the hair.

SUMMARY

The present invention is directed towards a hair clip with a flexible arm. The hair clip is adapted to fasten around a portion of the user's hair. The flexible arm is adapted to bend around a section of the user's hair such that the effective length of the flexible arm changes, and then lines up with a clip on a mating portion of the clip. The clip with the flexible arm puts less pressure on the hair than a standard hair clip.

DETAILED DESCRIPTION

Figure 1:
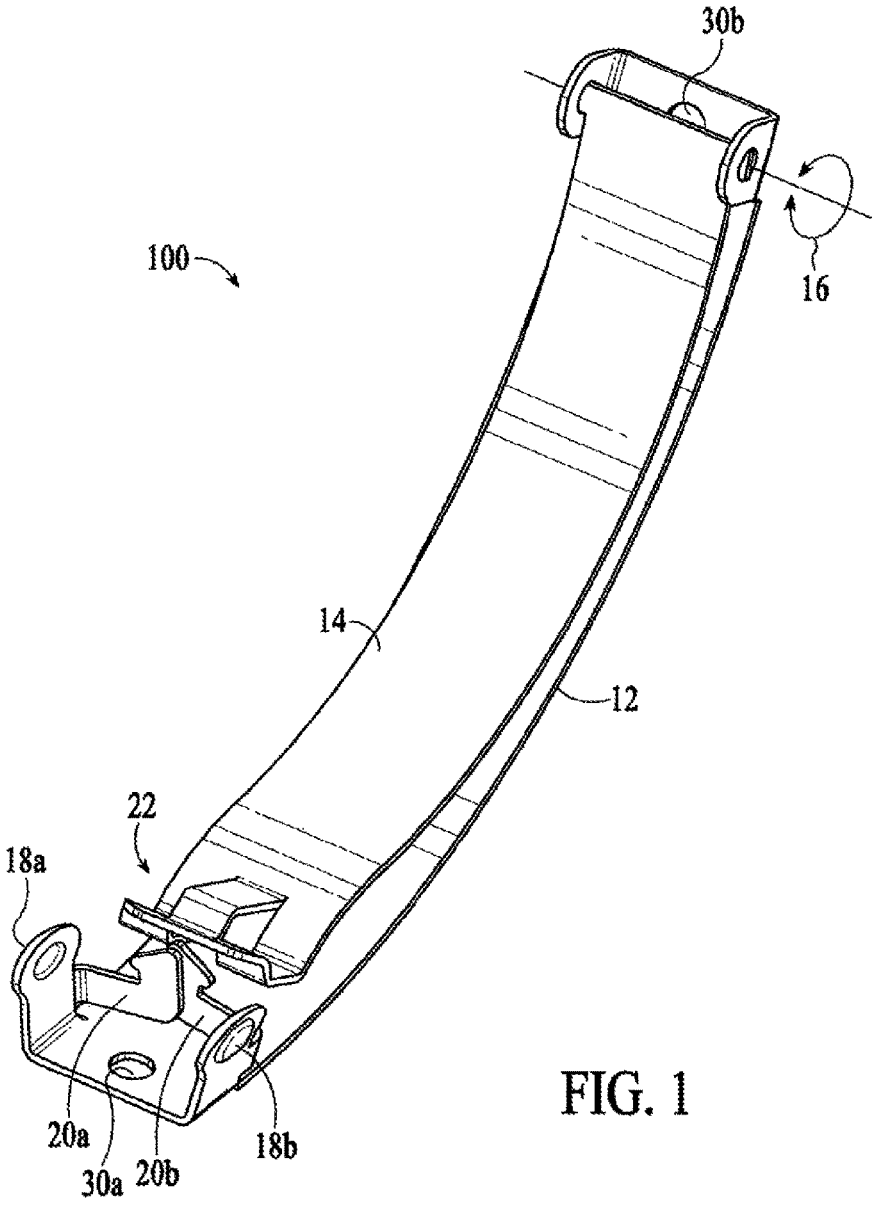
FIG. 1 is an interior perspective view of a hair clip according to some embodiments of the present invention.

In some embodiments of the present invention, as seen in FIG. 1, a hair clip with a flexible joining member is seen in an unloaded configuration 100. A first rigid arm 12 is adapted to provide the rigid backing for the hair clip. A second flexible arm 14 is pivotally attached to the first rigid arm 12. The second flexible arm 14 is adapted to pivot relative to the first rigid arm 12 along a pivot axis 16 located at the end of, or substantially near the end of, the second flexible arm 14.

The rigid arm 12 has a plurality of flexible arm clasp male portions 20*a*, 20*b*. The flexible arm 14 has a clasp receiving portion 22 adapted to receive the flexible arm clasp male portions 20*a*, 20*b* when the hair clip is in a loaded and closed configuration. In the unloaded configuration, the flexible arm 14 may have an effective length that is too short to have the clasp receiving portion 22 be able to receive the flexible arm clasp male portions 20*a*, 20*b*.

The rigid arm 12 may have a set of raised release tabs 18*a*, 18*b* which may support the flexible arm clasp male portions 20*a*, 20*b*. In some aspects, the raised release tabs 18*a*, 18*b*, the flexible arm clasp male portions 20*a*, 20*b*, and the remainder of the rigid arm 12 may all be formed from a single piece of metal. The rigid arm may also have accessory ports 30*a*, 30*b* at each end, which may assist in the mounting of decorative accessory portions to the hair clip.

Figure 2:
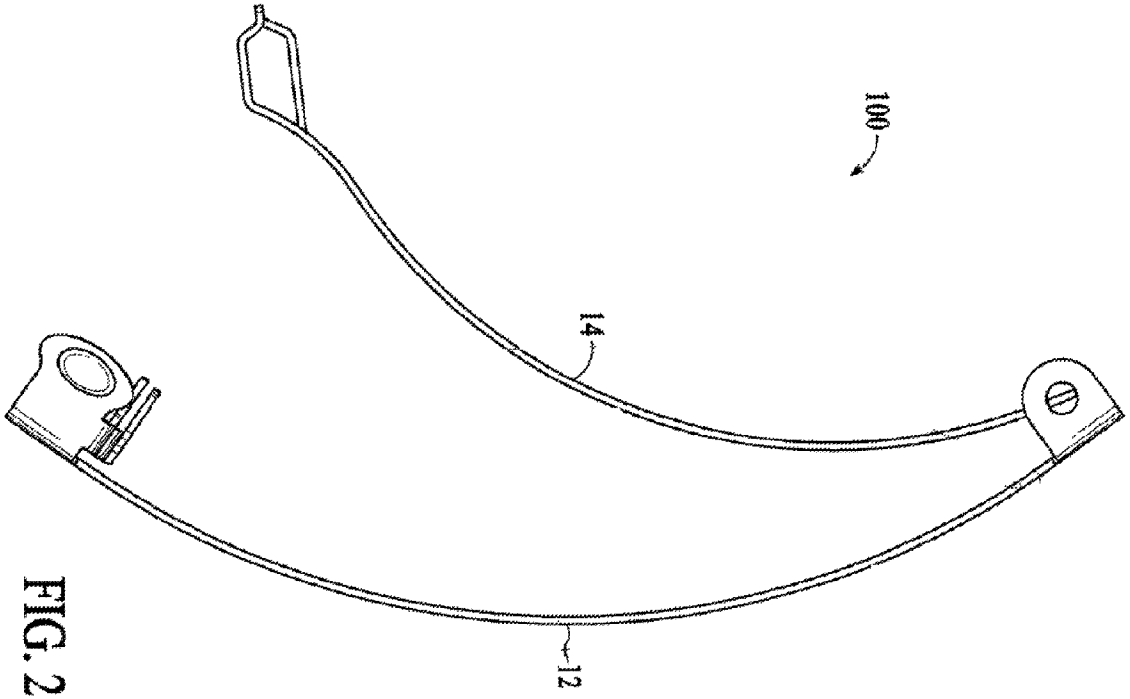
FIG. 2 is a side view of a partially open hair clip according to some embodiments of the present invention.

The flexible arm 14 is adapted to flex when loaded. For example, in an unloaded state, the flexible arm 14 is curved, as seen if FIGS. 1 and 2. In this unloaded state, the flexible arm has a shorter effective length than when loaded. The flexible arm pivots around the arm pivot axis 16, and the direct length from the pivot axis 16 in a direction to the flexible arm clasp male portions 20*a*, 20*b* is the length that the flexible arm must bridge in order to clasp. The linear length of the flexible arm from the pivot axis 16 directly to the clasp receiving portion 22 can be described as the effective length of flexible arm, as opposed to the length along the curved flexible arm. In the unloaded state, the flexible arm 14 may have an effective length that is too short to allow the clasp receiving portion 22 to receive the flexible arm male portions 20*a*, 20*b*.

Figure 3:
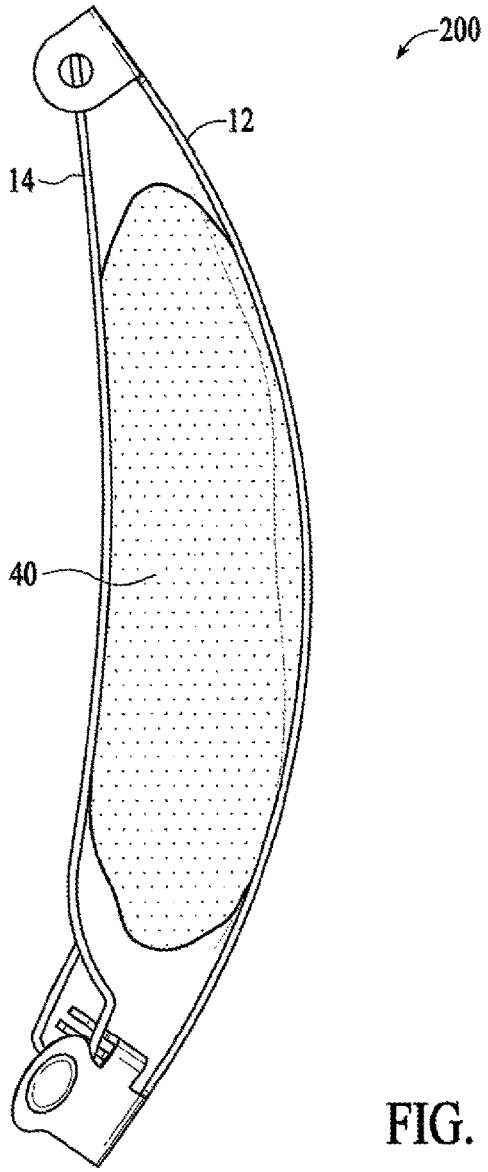
FIG. 3 is a side partial cross-sectional view of a closed hair clip enclosing hair according to some embodiments of the present invention.

FIG. 3 illustrates a loaded configuration 200 of the hair clip with a flexible joining member. With a clasped hair portion 40 contained by the clasped clip, the hair portion 40 deflects the flexible arm 14. With the deflection of the flexible arm 14 from a more curved configuration to a straighter configuration, the effective length of the flexible arm increases. The increase in the effective length of the flexible arm 14 places the far end of the flexible 14 in a location in which it can effectively mate with the clasp receiving portion 22 of the rigid arm 12. With this increase in the effective length of the flexible arm, the flexible arm would now be able to clasp to the rigid arm. In contrast to prior designs where the arms are relatively rigid, and wherein the rigid arms may place significant force on the clasped hair portion, with the present design a lower clasping force may be placed upon the hair. This lower clasping force greatly reduces the damage to the hair known to be a drawback of previous hair clip designs. Further, the flexibility of the inner arm allows for more load spreading on the captured hair. Is some aspects, hair clips according to embodiments of the present invention encompass the hair, surrounding the hair more gently, in contrast to prior clips which put more pressure in the middle section of the captured hair, which may lead to hair damage.

Figure 4:
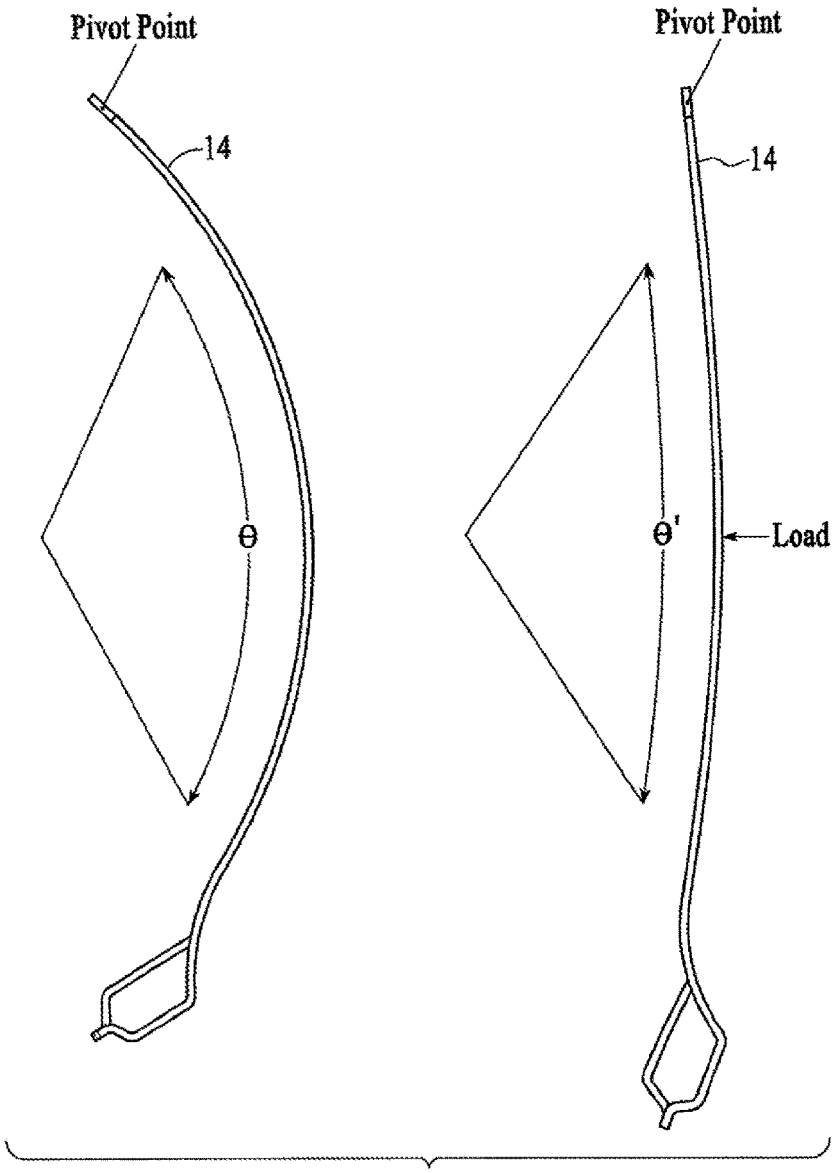
FIG. 4 is an illustration depicting the flexible aspect of the flexible arm according to some embodiments of the present invention.

FIG. 4 illustrates the change in the effective length of the flexible arm 14. In the unloaded state, the curvature of the flexible arm is much greater. With this curved, unloaded, state the effective length is shorter. With the addition of load onto the flexible arm, the flexible arm deflects into a straighter configuration, and the effective length is greater. With a greater effective length, the flexible arm is now able to clasp to the rigid arm. With prior systems, both arms were adapted to fasten without deflection, and were rigid in order to minimize deflection, and to allow the clasping elements to remain aligned. The downside of such an approach is that significant force was placed upon the clasped hair, resulting in damage to the hair including hair breaking in area in which it was clasped. In contrast, with a flexible arm there is not a need to retain the alignment of the clasping elements, as that alignment is attained with the aid of the clasped hair, which deflects the flexible arm. The deflection of the clasped arm increases its effective length, which then allows for the alignment of the clasping elements. The alignment may include both a change of the effective length of the flexible arm so the clasp interface zones are aligned with regard to length, and also angular deflection/rotation of the end of the flexible arm such that the interface zones of the clasp and receiver portions are substantially parallel. As deflection is desired as opposed to discouraged, the flexible arm may be flexible enough such that the deflection, and effective elongation, of the flexible arm occurs without too much pressure on the clasped hair.

Figure 5:
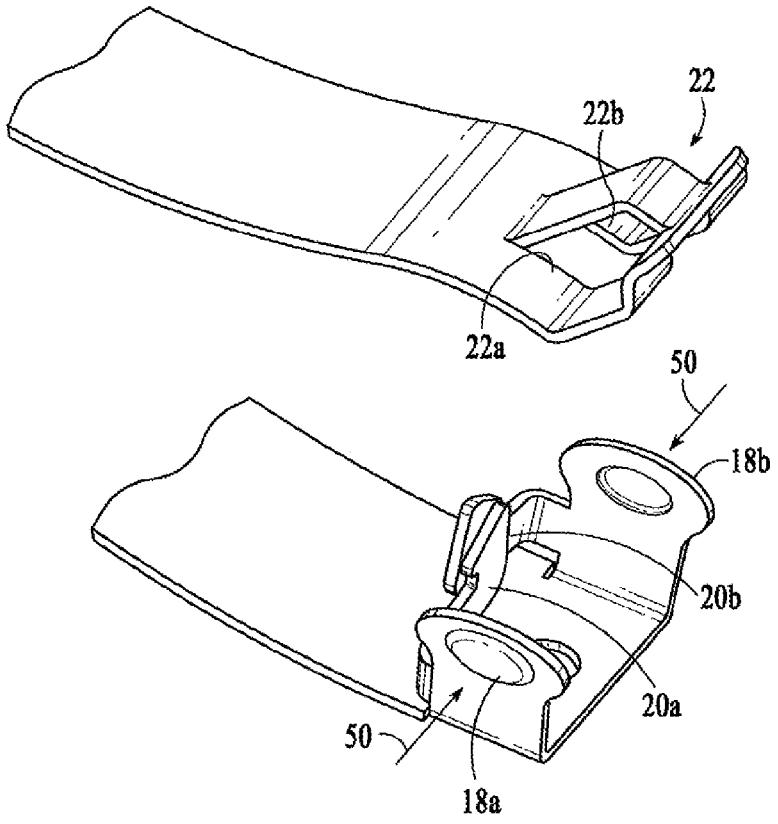
FIG. 5 is a partial cutaway view of the fastening portion of the hair clip according to some embodiments of the present invention.
Figure 6:
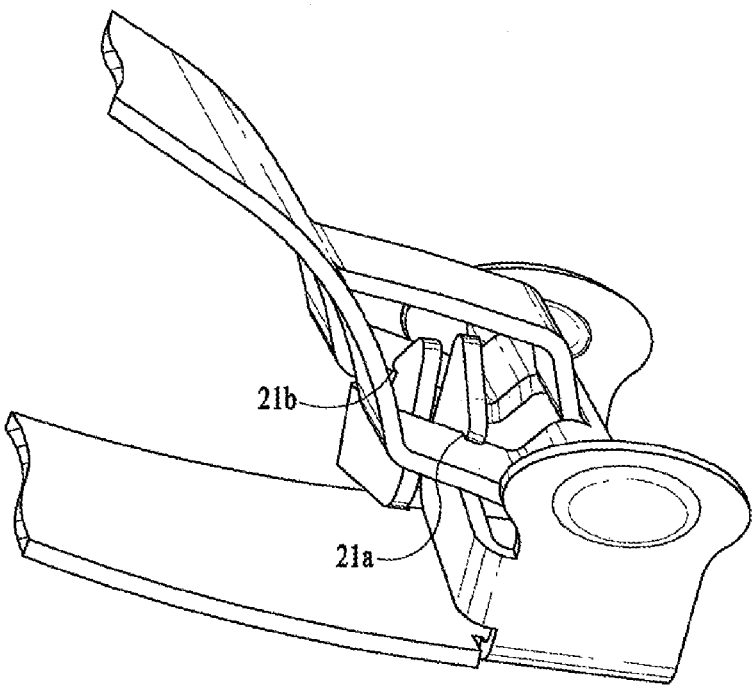
FIG. 6 is a partial cutaway view of the fastening portion in a fastened configuration according to some embodiments of the present invention.

FIGS. 5 and 6 illustrates aspects of clasping elements of the hair clip according to some embodiments of the present invention. The flexible arm 14 has a clasp receiving portion 22, which further includes clasp interface zones 22*a*, 22*b*. The rigid arm 16 includes flexible clasp male portions 20*a*, 20*b*, which are adapted to have their clasp male portion interface zones 21*a*, 21*b* reside upon the clasp receiver interface zones 22*a*, 22*b* when the clasp is engaged. The flexible clasp male portions 20*a*, 20*b* are able to be moved to disengage from the interface zones 22*a*, 22*b* of the clasp receiving portion 22 when force 50 is applied to the raised release tabs 18*a*, 18*b*. When the effective length of the flexible arm is sufficiently long to allow the clasp receiving interface zones 22*a*, 22*b* to receive the clasp male portions 20*a*, 20*b* the hair clip may be effectively clasped into a closed position.

FIG. 6 illustrates the clasp in an engaged configuration. The clasp male portions 20*a*, 20*b* have been engaged onto the receiving interface zones 22*a*, 22*b* of the clasp receiving portion 22. There is some length to the receiving interface zone surfaces 22*a*, 22*b*, which allows for some variation in the effective length of the flexible arm. The effective length of the flexible arm 14 will be determined by how much hair has been selected to be clasped. The flexible clasp male portions 20*a*, 20*b* have angled top surfaces such that the flexible clasp male portions 20*a*, 20*b* may be pushed up into the slot in the clasp receiving portion 22, and as the clasp male portions are pushed up there is a resultant force to bend the flexible male portions 20*a*, 20*b* towards each other, narrowing their overall relative width. Once the angled upper surface clears the top of the sides of the slot in the clasp receiving portion, the flexible clasp male portions 20*a*, 20*b* will snap outward, resulting in the clasping of the rigid outer arm to the flexible inner arm. In order to release the clasp, the raised release tabs 18*a*, 18*b* are squeezed together, and as the flexible clasp male portions 20*a*, 20*b* extend out from the release tabs, pressure placed upon the release tabs in squeezing the release tabs together will push each of the male portions towards the center of the rigid arm, reducing the width of the male portions pair, and thus allowing it to fit within the width of the slot in the clasp receiving portion 22 to open the hair clip and release the captured hair.

In some aspects, as seen in FIG. 6, the clasp male portions 20*a*, 20*b*, are seen raised in a vertical plane relative to the end of the rigid arm 16. The flat surfaces of the interface zones 22*a*, 22*b* of the clasp receiving portion 22 are substantially perpendicular to the vertical plane of the clasp male portions 20*a*, 20*b*. This configuration also places the contact zones 21*a*, 21*b* of the clasp male portions 20*a*, 20*b* in position such that they are parallel to the interface zones 22*a*, 22*b* of clasp receiving portion 22.

Figure 7:
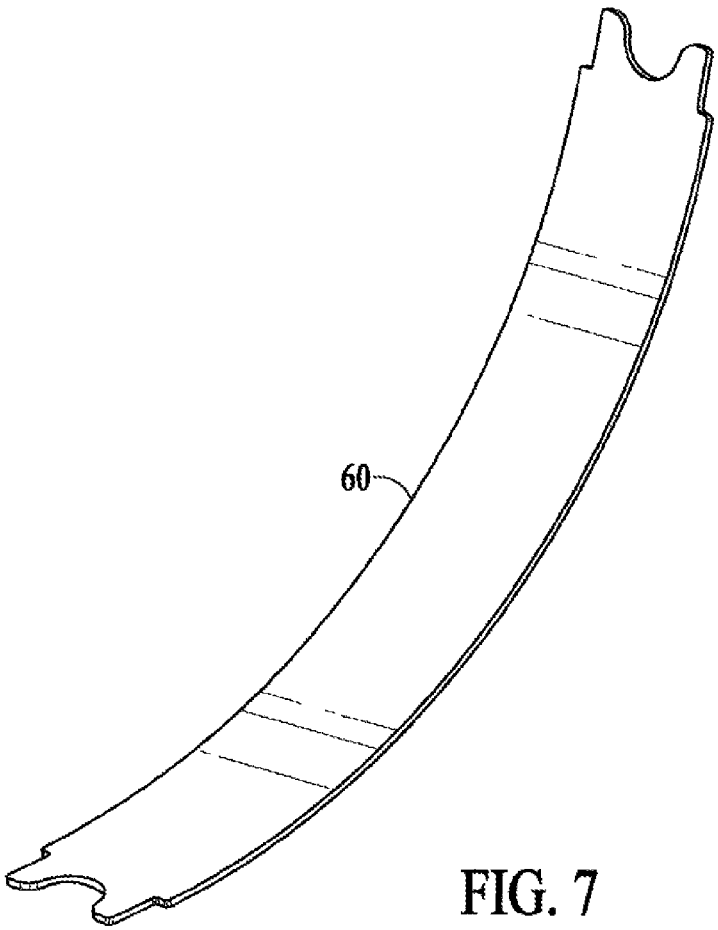
FIG. 7 is a view of a clip shield according to some embodiments of the present invention.
Figure 8:
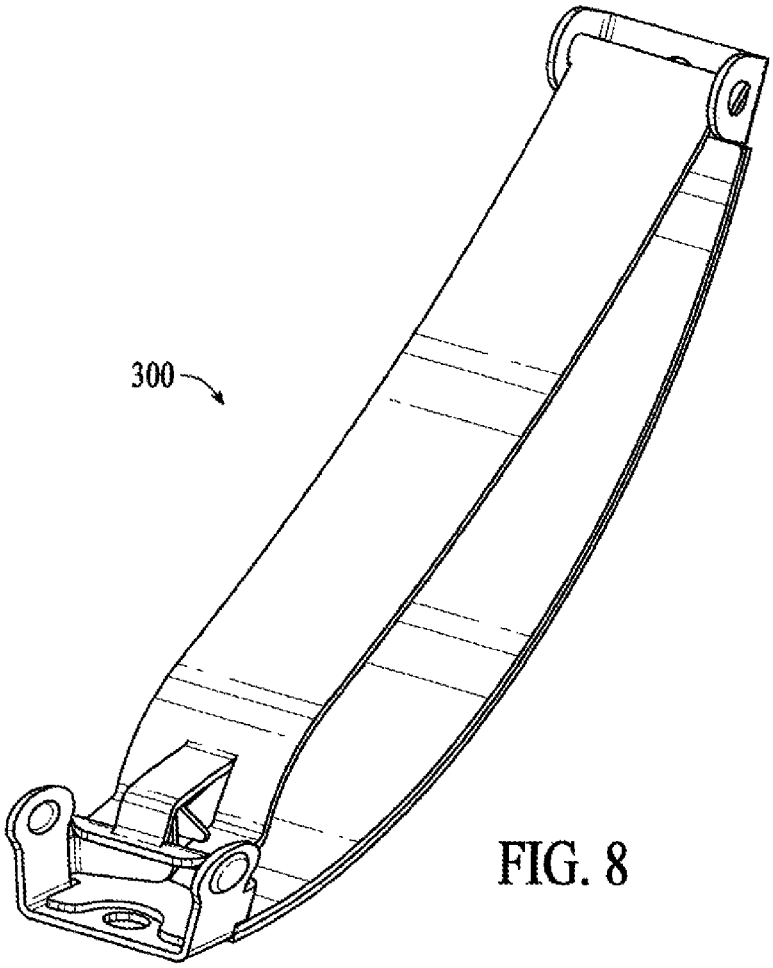
FIG. 8 is a view of a hair clip in an unloaded configuration according to some embodiments of the present invention.

FIG. 7 illustrates a frictional insert 60 which may be used to line the interior curved surface of the rigid arm 16. FIG. 8 illustrates an embodiment 300 of a hair clip with a frictional insert according to some embodiments of the present invention.

Figure 9A:
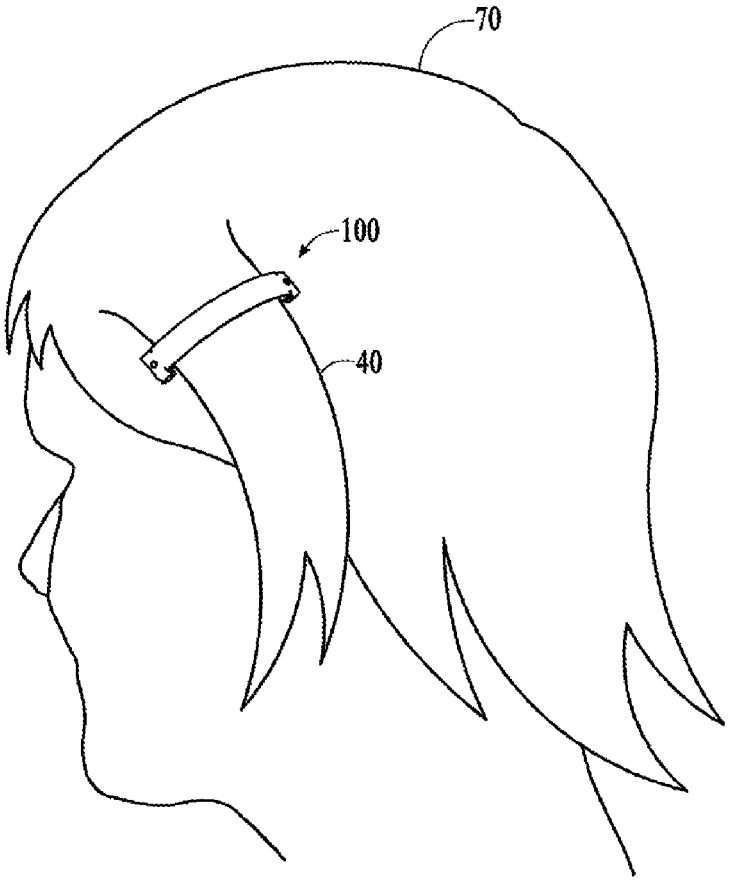
FIG. 9A is an illustration of a user wearing a hair clip.
Figure 9B:
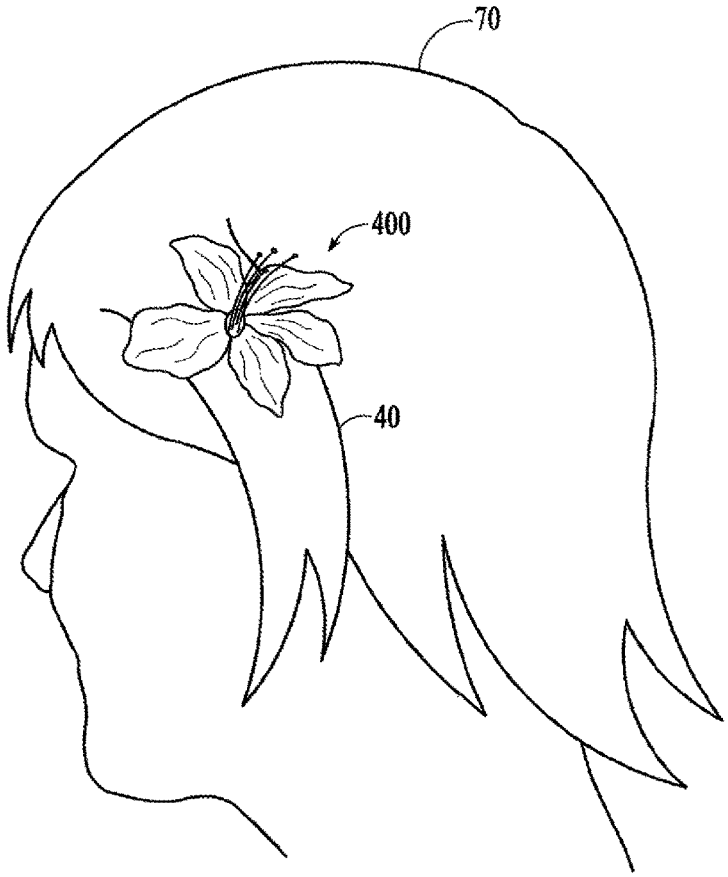
FIG. 9B is an illustration of a user wearing a hair clip with accessory ornamentation according to some embodiments of the present invention.

In some aspects, as seen in FIG. 9*a*, a user 70 is wearing a hair clip 100. The hair clip 100 is clasped around a clasped hair portion 40, with the clasp engaged. FIG. 9B illustrates a hair clip 400 being worn by a user 70. The hair clip 400 may have a decorative accessory affixed thereupon. The decorative accessory may be affixed to the accessory ports 30*a*, 30*b*. The hair clip 400 is seen clasped around a clasped hair portion 40

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

What is claimed is:

1. A hair clip comprising:

a curved first rigid arm, said first rigid arm comprising a first end and a second end, said first end of said first rigid arm comprising a first clamping interface comprising a first clasp portion;

a second flexible arm, said second flexible arm comprising a first end and a second end, said first end of said second flexible arm comprising a second clamping interface comprising a second clamp portion, said second flexible arm curved in a first unloaded configuration, said second end of said second flexible arm pivotally connected to said second end of said first rigid arm around a first pivot axis;

wherein said second flexible arm is adapted to deflect from a first unloaded configuration to a second loaded configuration, and wherein said first clamping interface and said second clamping interface align to clasp said first clasp portion and said second clasp portion together when said second flexible arm is deflected into the second loaded configuration around a clamped item, wherein the alignment of said first clamping interface to said second clamping interface comprises alignment along the length of said first rigid arm, wherein the distance between said first pivot axis and the second clamping interface on said second flexible arm increases in said second loaded configuration, and wherein the distance between said first pivot axis and the second clamping interface on said second flexible arm is too short to allow for said second flexible arm to clasp together with said first rigid arm in said first unloaded configuration.

2. The hair clip of claim 1 further comprising a frictional insert along an inner surface of said first rigid arm.

3. The hair clip of claim 1 wherein said first rigid arm further comprises one or more accessory ports.

4. The hair clip of claim 3 further comprising a decorative accessory mounted onto said one or more accessory ports.

5. The hair clip of claim 1 wherein said first rigid arm further comprises one or more first clasping elements, and wherein said second flexible arm further comprises one or more second clasping elements, said first clasping elements adapted to mate to said second clasping elements.

6. The hair clip of claim 5 further comprising release tabs coupled to the one or more first clasping elements.

7. The hair clip of claim 5 further comprising release tabs coupled to the one or more second clasping elements.

8. The hair clip of claim 5 wherein said first clasping elements comprise one or more first clasping interface surfaces and wherein said second clasping elements comprise one or more second clasping interface surfaces.

9. The hair clip of claim 8 wherein said first clasping interface surfaces and said second clasping interface surfaces are substantially parallel when said hair clip in said second loaded configuration.

10. The hair clip of claim 1 wherein said second flexible arm is substantially straightened in said second loaded configuration.

11. The hair clip of claim 10 wherein said first rigid arm further comprises one or more first clasping elements, and wherein said second flexible arm further comprises one or more second clasping elements, said first clasping elements adapted to mate to said second clasping elements.

12. The hair clip of claim 11 further comprising release tabs coupled to the one or more first clasping elements.

13. The hair clip of claim 11 further comprising release tabs coupled to the one or more second clasping elements.

14. The hair clip of claim 13 wherein said first clasping elements comprise one or more first clasping interface surfaces and wherein said second clasping elements comprise one or more second clasping interface surfaces.

15. The hair clip of claim 14 wherein said first clasping interface surfaces and said second clasping interface surfaces are substantially parallel when said hair clip in said second loaded configuration.

* * * * *